US011613851B2

(12) United States Patent
Nosker et al.

(10) Patent No.: US 11,613,851 B2
(45) Date of Patent: Mar. 28, 2023

(54) POLYMER-BASED RAILROAD TIE HAVING ENHANCED BALLAST INTERACTION

(71) Applicant: Rutgers, The State University of New Jersey, New Brunswick, NJ (US)

(72) Inventors: Thomas J. Nosker, Stockton, NJ (US); Arya S. Tewatia, Piscataway, NJ (US)

(73) Assignee: RUTGERS, THE STATE UNIVERSITY OF NEW JERSEY, New Brunswick, NJ (US)

( * ) Notice: Subject to any disclaimer, the term of this patent is extended or adjusted under 35 U.S.C. 154(b) by 149 days.

(21) Appl. No.: 16/753,208

(22) PCT Filed: Oct. 24, 2018

(86) PCT No.: PCT/US2018/057232

§ 371 (c)(1),
(2) Date: Apr. 2, 2020

(87) PCT Pub. No.: WO2019/089292

PCT Pub. Date: May 9, 2019

(65) Prior Publication Data

US 2020/0283962 A1 Sep. 10, 2020

Related U.S. Application Data

(60) Provisional application No. 62/580,692, filed on Nov. 2, 2017.

(51) Int. Cl.
*E01B 13/00* (2006.01)
*E01B 3/10* (2006.01)
(Continued)

(52) U.S. Cl.
CPC ..... *E01B 13/00* (2013.01); *E01B 3/10* (2013.01); *E01B 3/18* (2013.01); *E01B 3/44* (2013.01); *E01B 3/46* (2013.01)

(58) Field of Classification Search
CPC ... E01B 1/007; E01B 3/00; E01B 3/02; E01B 3/10; E01B 3/16; E01B 3/18; E01B 3/36; E01B 3/44; E01B 3/46; E01B 13/00
See application file for complete search history.

(56) References Cited

U.S. PATENT DOCUMENTS 1,615,744 A * 1/1927 De Los Cobosy Cerda et al. ..... E01B 3/36 238/115
4,083,491 A * 4/1978 Hill ..... E01B 3/10 238/98
(Continued)

FOREIGN PATENT DOCUMENTS

DE 2735797 A * 9/1977 ..... E01B 1/007
DE 2735797 A1 9/1978
(Continued)

*Primary Examiner* — Zachary L Kuhfuss
*Assistant Examiner* — Cheng Lin
(74) *Attorney, Agent, or Firm* — Fox Rothschild LLP

(57) ABSTRACT

A railroad tie formed of a polymeric or polymeric composite material and configured for enhanced mechanical interaction with an underlying ballast. The tie includes at least a top longitudinal surface, a pair of side longitudinal surfaces, a bottom longitudinal surface, and two end faces. At least the bottom longitudinal surface includes a plurality of indentations formed along a length thereof. Additionally, the tie includes at least one serrated edge portion having a plurality of serrations, the at least one serrated edge portion formed along at least part of the longitudinal length of the tie at an edge between at least one of the side longitudinal surfaces and the bottom longitudinal surface to provide for enhanced mechanical interaction with the ballast.

20 Claims, 3 Drawing Sheets

(51) Int. Cl.

| | |
|---|---|
| ***E01B 3/18*** | (2006.01) |
| ***E01B 3/46*** | (2006.01) |
| ***E01B 3/44*** | (2006.01) |

(56) References Cited

U.S. PATENT DOCUMENTS

| | | | | |
|---|---|---|---|---|
| 5,609,295 | A * | 3/1997 | Richards | E01B 3/36 238/106 |
| 6,191,228 | B1 * | 2/2001 | Nosker | E01B 3/46 525/240 |
| 7,011,253 | B2 | 3/2006 | Nosker et al. | |
| 8,680,165 | B2 | 3/2014 | Cialone et al. | |
| 2003/0085293 | A1 * | 5/2003 | Nosker | E01B 3/10 238/29 |
| 2004/0232253 | A1 * | 11/2004 | Hansen | E01B 3/44 238/29 |
| 2007/0187522 | A1 * | 8/2007 | Kirchmer | B29C 45/14819 238/84 |
| 2008/0179418 | A1 | 7/2008 | Brough et al. | |
| 2013/0008973 | A1 * | 1/2013 | Nosker | E01B 3/00 238/35 |
| 2016/0024720 | A1 * | 1/2016 | Cialone | E01B 3/46 238/85 |

FOREIGN PATENT DOCUMENTS

| | | | |
|---|---|---|---|
| DE | 202011050077 | U1 | 7/2011 |
| WO | 2006116405 | A2 | 11/2006 |

* cited by examiner

POLYMER-BASED RAILROAD TIE HAVING ENHANCED BALLAST INTERACTION

CROSS-REFERENCE TO RELATED APPLICATIONS

This application claims priority to U.S. Provisional Patent Application No. 62/580,692, filed Nov. 2, 2017, the disclosure of which is incorporated entirely herein by reference.

BACKGROUND

The present disclosure relates generally to manufactured railroad ties and, in particular, to railroad ties composed of a polymeric or polymeric composite material and having a plurality of dimples and serrated edges for enhanced interaction between the ties and the underlying ballast material.

Typical railroad ties manufactured from wood require frequent replacement due to exposure to the environment, including weather, insects and micro-organisms, all of which can shorten the life of a wooden tie. Wooden ties may also be chemically treated to lengthen their life, but such treatment raises environmental concerns, and adds to the cost of manufacturing the tie. It is known to manufacture ties from a plastic or composite material, which alleviates the problems associated with wooden ties, but which also causes problems not associated with wooden ties.

Ties made of wood tend to settle into the ballast (typically rocks) over a period of time and repeated loadings, and, because the properties of wood orthogonal to the long axis of tie are much weaker than the properties along the axis, the ties become naturally dimpled on the bottom as they settle into the ballast. This dimpling, and the related mechanical interaction between the wooden ties and the ballast, aid in keeping the tie anchored in place.

In the U.S., a typical railroad tie is rectangular in shape, having a cross section 7 inches in height by 9 inches in width. Railroad ties manufactured from plastics or composites are typically the same size and shape as ties made of wood, and must meet the same structural specification as wooden ties. Specifically, the tie must not allow an increase in the gauge of the tracks by more than 0.125 inches under a lateral load of 24,000 lbs. and a static vertical load of 39,000 lbs. In addition, the tie must be able to withstand a dynamic vertical load of 140,000 lbs.

The mechanical properties of plastic and composite ties prevent these ties from becoming dimpled and indented with ballast over time as occurs with wooden ties. To overcome this, ties manufactured from plastics or composites sometimes have a pattern embossed or imprinted on the bottoms and sides to allow increased mechanical interaction with the ballast, to emulate the effect that occurs naturally with wooden ties. For example, U.S. Pat. No. 7,011,253 discloses such a tie having a pattern cut, molded, or embossed on at least one surface thereof in the form of a plurality of shapes or dimples of identical depth. However, these plastic and composite ties having this plurality of shapes or dimples on a bottom surface of the tie may not provide a desired level of mechanical interaction between the ties and the ballast. Therefore, it would be advantageous to have a tie composed of a plastic or composite material which includes additional features for enhanced ballast interaction.

SUMMARY

According to an aspect of the disclosure, a railroad tie formed of a polymeric or polymeric composite material is disclosed. The tie includes at least a top longitudinal surface, a pair of side longitudinal surfaces, a bottom longitudinal surface, and two end faces, wherein at least the bottom longitudinal surface includes a plurality of indentations formed along a length of the bottom longitudinal surface, and at least one serrated edge portion having a plurality of serrations is formed along at least part of the longitudinal length of the tie at an edge between at least one of the side longitudinal surfaces and the bottom longitudinal surface. The plurality of indentations and the at least one serrated edge portion are configured to provide increased mechanical interaction between the tie and an underlying ballast.

In accordance with another aspect of the disclosure, a method of forming a railroad tie having enhanced mechanical interaction with an underlying ballast is disclosed. The method includes forming an elongated tie of a polymeric or polymeric composite material, the tie having at least a top longitudinal surface, a pair of side longitudinal surfaces, a bottom longitudinal surface, and two end faces. The method also includes forming a plurality of indentations along at least a length of the bottom longitudinal surface, and forming at least one serrated edge portion having a plurality of serrations along at least part of the longitudinal length of the tie at an edge between at least one of the side longitudinal surfaces and the bottom longitudinal surface.

DETAILED DESCRIPTION

Figure 1A:
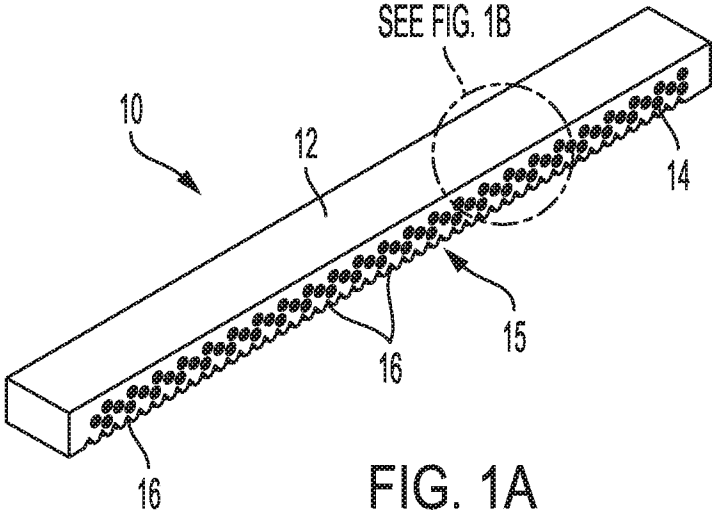
FIG. 1A shows a perspective view of a railroad tie manufactured in accordance with an aspect of the disclosure.
Figure 1B:
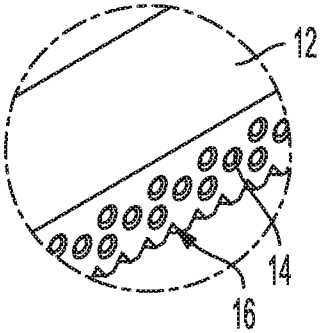
FIG. 1B shows a detailed view of a portion of the railroad tie of FIG. 1A.

The following description is made for the purpose of illustrating the general principles of the present system and method and is not meant to limit the inventive concepts claimed in this document. Further, particular features described in this document can be used in combination with other described features in each of the various possible combinations and permutations.

Unless otherwise specifically defined in this document, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified. Unless defined otherwise, all technical and scientific terms used herein have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used herein, the term "comprising" means "including, but not limited to". Additionally, use the term "couple", "coupled", or "coupled to" may imply that two or more elements may be directly connected or may be indirectly coupled through one or more intervening elements.

In this document, position-identifying terms such as "distal", "proximal", "end", "vertical", "horizontal", "front", "rear", "top", and "bottom" are not intended to limit the invention to a particular direction or orientation, but instead are only intended to denote relative positions, or positions corresponding to directions shown when a railroad tie is oriented as shown in the Figures.

An object of the present disclosure is to provide railroad ties, such as plastic or plastic composite ties, configured for enhanced mechanical interaction between the each respective tie and the ballast. That is, the ties are configured for increased resistance to sliding within the ballast (e.g., rocks) of the railroad bed, including sliding lengthwise under load (i.e., in the direction of the longitudinal axis of the tie) and/or sideways under load (i.e., in the direction perpendicular to the longitudinal axis, such as in the direction of the latitudinal axis). It is to be understood that while the railroad ties discussed in the present disclosure are formed of plastic or plastic composite materials, ties made from wood or concrete or reinforced concrete may also be used.

As will be discussed further below, enhanced ballast interaction may be achieved in accordance with the disclosure by providing the plastic and/or plastic composite ties with a textured surface on at least a bottom surface of each tie, as well as a serrated edge portion running along at least a part of the length of one or more bottom longitudinal edges of the tie. Such a configuration aids in anchoring the ties within the ballast of the railroad beds. In particular, the ties are provided with a pattern of indentations within at least a bottom surface that contacts the ballast, which itself increases the tie's resistance to sliding, particularly in the direction along the longitudinal axis. These indentations are preferably designed to inhibit such sliding, while also minimizing stress within the ties, and the indentations may have a varying depths, dependent upon their location upon the tie surface relative to the tie plates. In addition to the indentations, at least one serrated edge portion is configured to run along one or more of the bottom longitudinal edges, thereby providing supplemental mechanical interaction between the tie and the ballast.

Referring to FIGS. 1A-1D, a plastic or plastic composite tie 10 in accordance with an aspect of the disclosure is shown. Tie 10 includes a top surface 12, upon which a pair of rail plates (now shown) for holding respective rails may be mounted. Additionally, a plurality of concave indentations 14 are formed on the respective longitudinal side surfaces of tie 10. When tie 10 is partially embedded in the underlying ballast (e.g., rocks), these side surface indentations 14 may each mechanically interact with the ballast and provide resistance to sliding, particularly along the longitudinal axis of tie 10, but also in the directions perpendicular to the longitudinal axis. Generally, the indentation pattern comprises two structural aspects: the size and shape of the concave indentations 14 placed in the tie surface, and the relative location of each indentation 14. Additionally, while shown as substantially circular indentations in FIGS. 1A-1D, the shapes of the indentations 14 may vary. For example, the shapes can be diamond, oval, square, rectangular, hemispherical, octagonal, etc., having angled sidewalls. In some aspects, the shapes of the indentations are either a truncated cone or a truncated pyramid.

The indentations 14 within tie 10 may be all the same or may be different. For example, tie 10 may include both truncated cone indentations and truncated pyramid indentations. These indentations 14 may repeated, either regularly or irregularly, along both side surfaces of the tie 10. Alternatively, the indentations may be located along only one side surface of the tie 10. This pattern of indentations 14 (i.e., the combination of size, shape and location of the indentations 14) permits the ballast rocks to nest into the spaces formed by indentations 14, thereby enhancing mechanical interlocking between the ballast rocks and the tie 10 and increasing the tie's resistance to sliding/motion within the ballast.

In addition to the plurality of indentations 14 on the side surfaces of tie 10, at least one of the bottom longitudinal edges of tie 10 also includes a serrated edge portion 15. As shown in detail in FIG. 1B, serrated edge portion 15 includes a plurality of serrations 16 extending along a length of the tie 10. Serrations 16 are shown as being substantially pyramidal in shape, having angled sidewalls which are configured to mechanically interact with the ballast rocks, further supplementing the sliding resistance provided by other indentations located within the tie 10, including indentations 14 described above. The serrations 16 may be cut or embossed into the tie 10 after the tie 10 is formed, extruded into the tie 10 during continuous extrusion of the tie 10, or molded into the tie 10. The serrations 16 may have sidewalls which form an angle with respect to the longitudinal axis of the tie 10 of 30°-60°, especially 40°-50°, particularly 42.5°-47.5°, and particularly about 45°. An angle of about 45° may optimize the tie's resistance to motion within the ballast, while offering the lowest value of shear stress in both the tie material and the nested rocks. As a result, mechanical resistance to lateral movement of the tie 10 can be optimized, while minimizing the level of stress actually borne within the tie 10 itself. However, it is to be understood that the sidewalls of serrations 16 may have any appropriate angle relative to longitudinal axis of the tie 10, including angles less than 30° and angles greater than 60°.

Figure 1C:
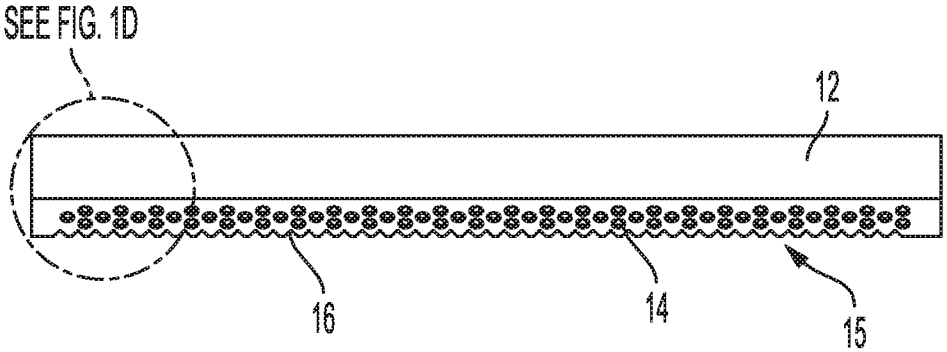
FIG. 1C shows a front perspective view of the railroad tie of FIG. 1A.
Figure 1D:
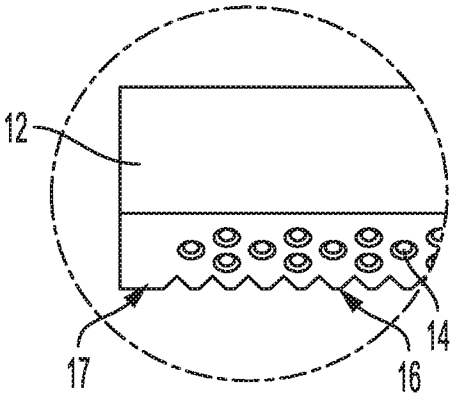
FIG. 1D shows a detailed view of a portion of the railroad tie of FIG. 1C.

Referring to FIGS. 1C-1D, serrated edge portion 15 is shown as extending along a substantial part of the bottom edge portion of tie 10, with the exception of small, non-serrated gaps 17 formed at or near the respective ends of tie 10. However, it is to be understood that serrated edge portion 15 need not extend along substantially the entire length of tie 10, and may instead be intermittent along the length of tie 10. Alternatively, serrated edge portion 15 may extend along the entire length of tie 10, thereby replacing gaps 17 with additional serrations 16.

While serrations 16 are shown in FIGS. 1A-1D as being substantially pyramidal in shape, it is to be understood that serrations 16 may be formed of other shapes, such as cubes, hemispheres, etc. Additionally, serrations 16 may each be formed having the same depth, or may be formed having one or more differing depths.

Figure 2A:
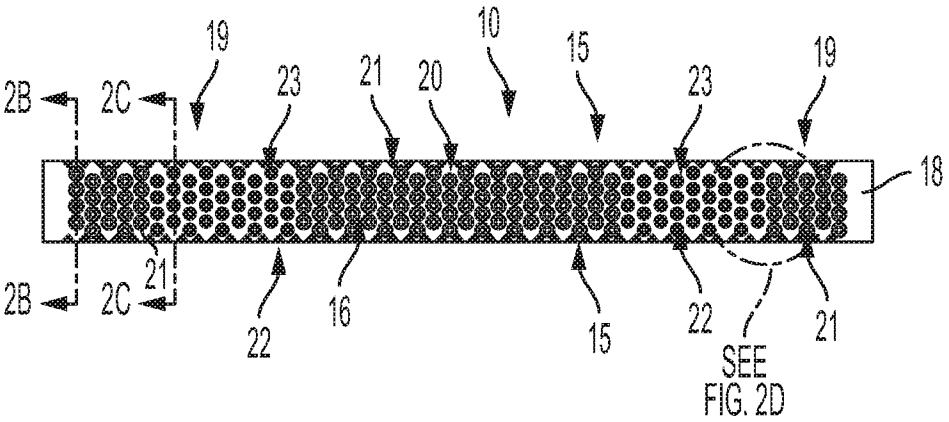
FIG. 2A shows a bottom view of the railroad tie of FIG. 1A.
Figure 2D:
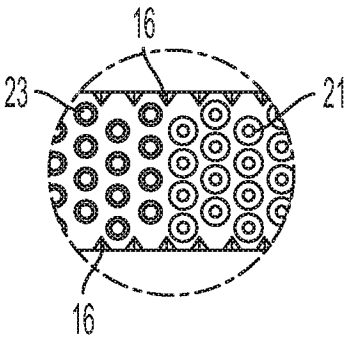
FIG. 2D shows a detailed view of a portion of the railroad tie of FIG. 2A.
Figure 2C:
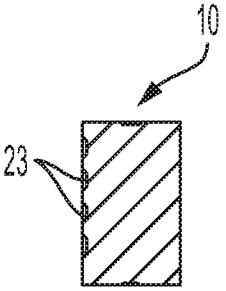
FIG. 2C shows a sectional view of another portion of the railroad tie of FIG. 2A.
Figure 2B:
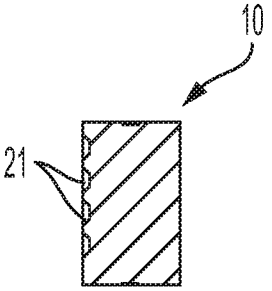
FIG. 2B shows a sectional view of a portion of the railroad tie of FIG. 2A.

Next, referring to FIG. 2A, a bottom view of tie 10 in accordance with an aspect of the disclosure is illustrated. Bottom surface 18 of tie 10 includes a plurality of indentations 21, 23 cut, molded, or otherwise formed into the surface 18. Similar to indentations 14 described above, indentations 21, 23 may each mechanically interact with the ballast and provide resistance to sliding, particularly along the longitudinal axis of tie 10, but also in the directions perpendicular to the longitudinal axis. Additionally, like indentations 14 and serrations 16, indentations 21, 23 may be cut or embossed into the tie 10 after the tie 10 is formed, extruded into the tie 10 during continuous extrusion of the tie 10, or molded into the tie 10

The size of the indentation 21, 23 cut, molded, extruded, or embossed into the tie 10 at their base can vary. The size of the base of the indentations 21, 23 is generally selected to optimally fit typical ballast sized rocks within the concave shape. For example, in one aspect, the base of the indentations 21, 23 has a relative diameter of ½" to 2½", especially ¾" to 2", particularly in the cases of the truncated cone or truncated pyramid shapes. Additionally, the depth of the indentations 21, 23 may also vary, but may be, e.g., ⅛" to ¾", and in particular ¼" to ½". The indentations 21, 23 are preferably deep enough to allow significant mechanical interaction between the tie 10 and ballast, but not deep enough into the tie 10 to interfere significantly with the spike-tie interaction.

Referring to FIGS. 2A-2D, the depth and number of the indentations 23 in the regions 22 below where the tie 10 comes into contact with a tie base plate (not shown) is less than the depth and number of the indentations 21 at the respective end regions 19 and central region 20 that is not in contact with the tie base plates. For example, in one aspect, indentations 23 may be less than 1", for example, ⅛" to ¾", especially ¼" to ½". However, the depth of indentations 21 at the end regions 19 and/or the central region 20 may be greater, e.g., up to 2 inches. The reason for the reduced depth and number of indentations 23 at the tie plate locations is that since the tie plates are where the railroad spikes or other fastening means are attached, it is generally desirable to limit the depth of the indentations 23 so that attachment of the spikes will avoid conflict between the spikes and the indentations 23 and/or will not induce splitting of the tie 10. In many ties, the tie plates are attached to the ties in a region which is 10" to 36" from each end, the tie plate generally being about 20" wide. Thus, for example, if tie 10 is 8.5 feet long and has indentations 21, 23 dispersed along the bottom longitudinal surface 18, each end region 19 extending the first 10 inches may have indentations 21 with a depth of up to 2 inches deep. Adjacent each end region 19, there may be regions 22 which each extend, e.g., 26 inches from end regions 19 where the indentations 23 have a depth of less than 1 inch. Then, the central region 20 may extend, e.g., 2.5 feet, and may again have indentations 21 with a depth up to 2".

In addition to having varying depths, the spacing between the indentations 21, 23 may also vary dependent upon the location upon bottom surface 18. In one aspect, the distance from the center of one indentation 21, 23 to the center of an adjacent indentation is, e.g., about 1½ to 2½ inches apart. However, it is to be understood that both the depths and distances apart of indentations 21, 23 may vary from those described herein. Additionally and/or alternatively, the depth and spacing of indentations 21, 23 may be the same along the entire bottom surface 18 of tie 10.

Referring again to FIG. 2A and FIG. 2D, serrated edge portions 15 including a plurality of serrations 16 are shown extending along substantially along the length of bottom edges of the tie 10. Again, it is to be understood that serrated edge portions 15 need not extend along substantially the entire length of tie 10, and may instead be intermittent along the length of the bottom edges of tie 10. Furthermore, while serrated edge portions 15 are shown as extending along the length of both bottom longitudinal edges of tie 10, it is to be understood that serrated edge portions 15 may alternatively extend along only one of the bottom longitudinal edges of tie 10.

Figure 3B:
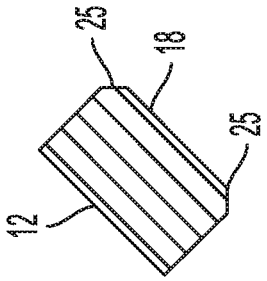
FIG. 3B shows a sectional view of a portion of the railroad tie of FIG. 3A.
Figure 3A:
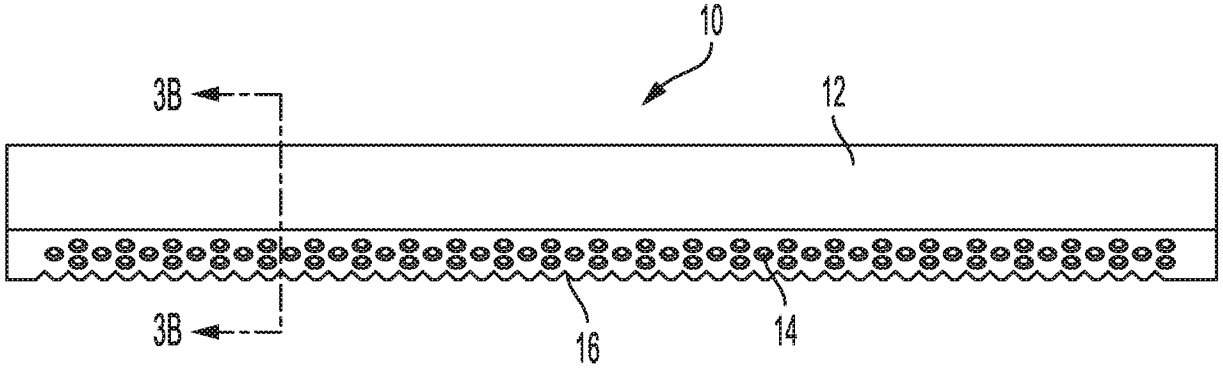
FIG. 3A shows another front perspective view of the railroad tie of FIG. 1A.

Referring to FIGS. 3A-3B, a more detailed view of the serrated edge portions is shown. Specifically, FIG. 3B illustrates a cross-sectional view along a section of tie 10. As shown, angular surfaces 25 are formed on each respective bottom longitudinal edge of tie 10, which angular surface 25 being capable of mechanically interacting with the ballast (e.g., rocks) so as to inhibit sliding of tie 10 within and/or upon the ballast. As noted above, the serrations 16 are not limited to the pyramidal shape as shown, and thus surfaces 25 may not necessarily be linear, but may be curved, dependent upon the shape of the serrations 16. Additionally, while the cross-sectional view shown in FIG. 3B shows serrations running along both bottom edges of tie 10, it is again to be understood that the serrated edge portions may only extend along one of the bottom longitudinal edges of tie 10.

The pattern(s) forming the indentations 14, 21, 23 and/or the serrations 16 may be molded into the tie 10 in a simple and inexpensive manner as part of a batch molding process. For example, a thin steel embossed plate approximately the length of the tie 10 and slightly thinner than the sides and the bottom dimensions of the tie 10 may be placed into the mold at the bottom and/or sides prior to filling the mold with the molten plastic or plastic composite composition. The plastic or composite then flows into the mold, taking on the shape of the embossed plates. After cooling, the tie 10 and plates are removed from the mold, and the plates may be separated from the tie 10 and placed back in the mold for the next molding cycle. Alternatively to embossed steel plates, other metal plates which are either embossed or have metal shapes fastened to them by, e.g., welding or with screws may be used.

Alternatively and/or additionally, the pattern may be embossed into the ties 10 as part of a batch mold or extrusion process or as part of a continuous extrusion process. For example, extruded or molded parts may be fed continuously or intermittently through a device including at least one heated roller, with the desired shapes attached thereto or machined into the roller, and at least one opposing roller being configured to press the plastic or composite tie 10 against the heated roller to mold the pattern into the tie 10.

Alternatively, the embossing can be performed using platens, rather than rollers. For example, a plastic or composite tie can be inserted between the two or more platens of a press. One platen may include a heated tool with the desired indentation and serration shapes attached thereto (or machined therein). The other platen is cold and supports the plastic tie. The heated platen may pressed into the plastic tie to mold the indentation and serration pattern into the tie. Alternative methods for providing the pattern of indentations and/or serrations into the surface of the tie may include laser cutting, chiseling, machining cutting, and the like.

The methods described above may be utilized with any type of polymeric or polymer composite tie. For example, the material for manufacturing the ties preferably have a continuous plastic phase. The polymers may be polyolefins, and, in particular, may be polyethylene such as HDPE. Polystyrene, high-density polypropylene (HDPP), polymethyl methacrylate (PMMA), and/or rubber may also be used in the polymer component. The polymer component may be used alone or in combination with a filler or reinforcing component such as fiber glass, mineral fillers (e.g., talc and/or gypsum), wood fibers, steel fibers, etc. In one aspect, the polymer component may be 35 to 100 wt. %, more preferably 40 to 100 wt. %, and especially at least 50 wt. % of the total composition. The filler/reinforcement component may be 0 to 65 wt. %, and especially 0 to 60 wt. % of the total composition.

The following are examples of suitable combinations of material: (1) HDPE and fiberglass; (2) HDPE, polystyrene and fiberglass; (3) HDPE, polypropylene and fiber glass; (4) HDPE and talc and/or gypsum; (5) HDPE, rubber, mineral filler and fiber glass; (6) HDPE, polypropylene (PP) and wood fiber; (7) HDPE and wood fiber; (8) HDPE, polystyrene (PS) and wood fiber; (9) HDPE and polystyrene; and (10) HDPE and polycarbonate (PC), acrylonitrile butadiene styrene (ABS), and PC/ABS blends.

In accordance with one aspect of the disclosure, the tie 10 may be formed from a plastic composite material comprising 20-50 wt. % of a polystyrene component and 50-80 wt. % of a polyolefin component, wherein the polystyrene component contains at least 90 wt. % polystyrene and the polyolefin component contains at least 75 wt. % high-density polyethylene. In some embodiments, the composite may include about 25 to 45 wt. % (especially 30 to 40 wt. %) of the polystyrene component. Further, the composite may include about 55 to 75 wt. % (especially about 60 to 70 wt. %) of the polyolefin component. In one example, the composite may comprise 35 wt. % of the polystyrene component and 65 wt. % of the polyolefin component. The polystyrene component is preferably 100 wt. % polystyrene, although a minor manner of impurities, organic or inorganic, may be included. The polyolefin component may be made from a mixture of polyolefin materials, e.g., high-density polyethylene, low-density polyethylene, polypropylene, ethylene-propylene copolymers, and the like. The polyolefin component may comprise least 75 wt. % high-density polyethylene to ensure formation of a dual phase co-continuous interlocking three-dimensional network between the polystyrene component and the polyolefin component.

While both the polystyrene component and polyolefin component may be made from virgin materials, these materials may instead be formed from recycled plastics. Sources of recycled polystyrene include, e.g., disposable cups and containers, rigid styrene tableware, clothing hangers, and other containers. The recycled polystyrene may be utilized in any of its commonly available forms, for example, foamed (expanded) polystyrene, crystal polystyrene (general purpose), and high-impact polystyrene. Plastics for the polyolefin component may be obtained from the recycling of PET and HDPE beverage containers and other containers (e.g., 5 gallon pails and 55 gallon drums). However, the polyolefin may also be obtained from the mixed plastics portion of recycled stream obtained after removal of PET and unpigmented HDPE beverage containers. The ability to utilize these mixed plastics or commingled plastic portions provides both economic and environmental advantages.

While the composite material forming the railroad tie 10 is described in terms of the polystyrene/polyolefin system, it is also possible to utilize other materials to achieve a composite possessing the desired dual-phase morphology of wherein the phases intertwine such that they remain continuous throughout the composite material.

In accordance with another aspect of the disclosure, the ties 10 may be composed of an immiscible polymer blend comprising (1)) polyethylene (PE) and (2) acrylonitrile-butadiene-styrene (ABS), polycarbonate (PC), or a mixture of ABS and PC. In some embodiments, the PE may be HDPE. Immiscible polymer blends composed of PE in combination with PC and/or ABS (or a mixture thereof) may increase the stiffness of any article manufactured using such a blend. In the case of ties 10, the modulus E of the composition may be at least about 170,000 and have a strength of at least 2500 psi. For example, a tie 10 formed of a blend containing about 10% ABS and about 90% HDPE would have a modulus of about 175,000.

In some aspects of the disclosure, the composite material forming the tie 10 may have a compression modulus of at least about 172,000 psi, especially at least about 200,000 psi. The composite material may further exhibit a compression strength of preferably at least about 3,000 psi, especially at least about 3,500 psi, and a compression yield stress of at least about 3,000 psi, especially at least about 3,500 psi. The flexural modulus of the composite material may be at least about 172,000 psi, especially at least about 200,000 psi, and the flexural strength may be at least about 3,000 psi, especially at least about 3,500 psi.

While the examples of tie 10 described above pertain to standard railroad ties in the U.S., it is to be understood that the size of railroad ties may vary by application, and often vary from country to country. In the U.S., the standard railroad tie size for main rail lines is about 9 inches wide by 7 inches thick by approximately 8.5 feet long. For short lines, the size of the ties is about 6 inches by 8 inches by 8.5 feet. For some freight and passenger lines in which a third rail is used, the ties may be 7 inches by 9 inches by 10 feet or 6 inches by 8 inches by 10 feet. In fact, for switch sets of rails, the ties can be even longer, e.g., up to 17 feet long.

The examples in the present disclosure are described in terms of measurements based upon gauges of railways used in the U.S. However, the described aspects of this disclosure are also applicable to areas of the world where differing size gauges and differing sizes of railway ties are used. Thus, the above description is only exemplary in nature and is not meant to limit the disclosure in any way.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the disclosure. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A railroad tie formed of a polymeric or polymeric composite material, the tie comprising at least a top longitudinal surface, a pair of side longitudinal surfaces, a bottom longitudinal surface, and two end faces, wherein:

at least the bottom longitudinal surface comprises a plurality of indentations formed along a length of the bottom longitudinal surface; and at least one serrated edge portion having a plurality of serrations is formed along at least part of the longitudinal length of the tie at an edge between at least one of the side longitudinal surfaces and the bottom longitudinal surface, wherein the plurality of indentations and the at least one serrated edge portion are configured to provide increased mechanical interaction between the tie and an underlying ballast, wherein the composite material is formed from an immiscible polymer blend comprising polyethylene, polypropylene, or a mixture thereof wherein the immiscible polymer blend possesses a dual-phase morphology wherein the phases intertwine such that they remain continuous throughout the composite material, and wherein the bottom longitudinal surface comprises:

regions lying below a pair of rail plate mounting locations upon the top longitudinal surface of the tie, and respective end regions and a central region not lying below the pair of rail plate mounting locations, the respective end regions and the central region being separated from each other by the regions lying below the pair of rail plate mounting locations; and wherein a pattern of the plurality of indentations formed at the respective end regions and the central region is uniform along the entire respective end regions and the central regions.

2. The railroad tie of claim 1, further comprising a plurality of indentations formed along the length of at least one of the pair of side longitudinal surfaces.

3. The railroad tie of claim 1, wherein at least some of the plurality of indentations are of differing depths.

4. The railroad tie of claim 1, wherein the at least one serrated edge portion extends continuously along the longitudinal length of the tie.

5. The railroad tie of claim 1, wherein the at least one serrated edge portion extends intermittently along the longitudinal length of the tie.

6. The railroad tie of claim 1, wherein the serrations of the at least one serrated edge portion are pyramidal in shape.

7. The railroad tie of claim 1, wherein the at least one serrated edge portion comprises a pair of serrated edge portions formed along at least part of the longitudinal length of the tie between each respective side longitudinal surface and the bottom longitudinal surface.

8. The railroad tie of claim 1, wherein at least one of a depth, a number, and a spacing of the plurality of indentations formed along a length of the bottom longitudinal surface varies dependent upon the location of the pair of rail plate mounting locations upon the top longitudinal surface of the tie.

9. The railroad tie of claim 8, wherein the number or depth of the plurality of indentations formed at the regions lying below the pair of rail plate mounting locations is less than the number or depth of the plurality of indentations formed at the respective end regions and the central region, respectively.

10. The railroad tie of claim 8, wherein the plurality of serrations is formed along at least part of a longitudinal length of the central region.

11. The railroad tie of claim 8, wherein the spacing between the plurality of indentations formed at the regions lying below the pair of rail plate mounting locations is greater than the spacing between the plurality of indentations formed at the respective end regions and the central region, respectively.

12. The railroad tie of claim 1, wherein the material further comprises polystyrene, rubber, or a mixture thereof.

13. The railroad tie of claim 1, wherein the material further comprises a filler component selected from the group consisting of fiber glass, mineral fillers, wood fibers, steel fibers, and mixtures thereof.

14. The railroad tie of claim 1, wherein the polyethylene comprises HDPE.

15. The railroad tie of claim 1, wherein the material comprises one of (1) HDPE and fiber-glass, (2) HDPE, polystyrene and fiberglass, (3) HDPE, polypropylene and fiber glass, (4) HDPE and talc or gypsum, (5) HDPE, rubber, mineral filler and fiber glass, (6) HDPE, polypropylene and wood fiber, (7) HDPE and wood fiber, (8) HDPE, polystyrene and wood fiber, (9) HDPE and polystyrene, and (10) HDPE and polycarbonate (PC), acrylonitrile butadiene styrene (ABS), and PC/ABS blends.

16. The railroad tie of claim 1, wherein the tie is formed from a plastic composite material comprising 20-50 wt. % of a polystyrene component and 50-80 wt. % of a polyolefin component, wherein the polystyrene component contains at least 90 wt. % polystyrene and the polyolefin component contains at least 75 wt. % high-density polyethylene.

17. A method of forming a railroad tie having enhanced mechanical interaction with an underlying ballast, the method comprising:

forming an elongated tie of a polymeric or polymeric composite material formed from an immiscible polymer blend comprising polyethylene, polypropylene, or a mixture thereof, the tie having at least a top longitudinal surface, a pair of side longitudinal surfaces, a bottom longitudinal surface, and two end faces, wherein the immiscible polymer blend possesses a dual-phase morphology wherein the phases intertwine such that they remain continuous throughout the composite material, forming a plurality of indentations along at least a length of the bottom longitudinal surface; and forming at least one serrated edge portion having a plurality of serrations along at least part of the longitudinal length of the tie at an edge between at least one of the side longitudinal surfaces and the bottom longitudinal surface, wherein the bottom longitudinal surface comprises:

regions lying below a pair of rail plate mounting locations upon the top longitudinal surface of the tie, and respective end regions and a central region not lying below the pair of rail plate mounting locations, the respective end regions and the central region being separated from each other by the regions lying below the pair of rail plate mounting locations; and wherein a pattern of the plurality of indentations formed at the respective end regions and the central region is uniform along the entire respective end regions and the central regions.

18. The method of forming the railroad tie of claim 17, further comprising forming a plurality of indentations along a length of at least one of the side longitudinal surfaces.

19. The method of forming the railroad tie of claim 17, further comprising forming serrated edge portions along at least part of the longitudinal length of the tie at both edges between at least one of the side longitudinal surfaces and the bottom longitudinal surface.

20. The method of forming the railroad tie of claim 17, further comprising forming the plurality of indentations at the regions lying below the pair of rail plate mounting locations to be at least one of shallower, fewer in number, and further spaced apart than the plurality of indentations formed at the respective end regions and the central region, respectively.

* * * * *